US007591452B2

(12) United States Patent
Kohama et al.

(10) Patent No.: US 7,591,452 B2
(45) Date of Patent: Sep. 22, 2009

(54) METHOD FOR PRODUCING MONODISPERSE BUBBLES

(75) Inventors: Yasuaki Kohama, 37-10, Hagurodai, Taihaku-ku, Sendai-shi, Miyagi (JP) 9820817; Masato Kukizaki, Miyazaki (JP); Tadao Nakashima, Miyazaki (JP)

(73) Assignees: Miyazaki Prefecture, Miyazaki-shi (JP); Yasuaki Kohama, Sendai-shi (JP)

( * ) Notice: Subject to any disclaimer, the term of this patent is extended or adjusted under 35 U.S.C. 154(b) by 519 days.

(21) Appl. No.: 10/572,375

(22) PCT Filed: Dec. 13, 2004

(86) PCT No.: PCT/JP2004/018558

§ 371 (c)(1), (2), (4) Date: Mar. 16, 2006

(87) PCT Pub. No.: WO2005/056168

PCT Pub. Date: Jun. 23, 2005

(65) Prior Publication Data

US 2006/0284325 A1 Dec. 21, 2006

(30) Foreign Application Priority Data

Dec. 15, 2003 (JP) ..... 2003-416945

(51) Int. Cl.
*B01F 3/04* (2006.01)

(52) U.S. Cl. ..... 261/96; 261/102; 261/122.1; 261/DIG. 26

(58) Field of Classification Search ..... 261/96, 261/99, 102, 104, 105, 107, 122.1, 122.2, 261/DIG. 26

See application file for complete search history.

(56) References Cited

U.S. PATENT DOCUMENTS 3,927,152 A * 12/1975 Kyrias ..... 261/122.1
3,941,862 A * 3/1976 Price et al. ..... 261/122.1
4,085,170 A * 4/1978 Simpson et al. ..... 261/1
4,581,137 A * 4/1986 Edwards et al. ..... 210/220
4,657,875 A 4/1987 Nakashima et al.

(Continued)

FOREIGN PATENT DOCUMENTS

JP 57-140334 A 8/1982

(Continued)

OTHER PUBLICATIONS

Korean Office Action dated Mar. 14, 2008, issued in corresponding Korean application No. 10-2006-7010664.

(Continued)

*Primary Examiner*—Scott Bushey
(74) *Attorney, Agent, or Firm*—Westerman, Hattori, Daniels & Adrian, LLP.

(57) ABSTRACT

The invention provides a method for producing bubbles that exhibit an excellent monodispersity. The invention relates to a method for generating bubbles by the injection and dispersion of a gas through a porous body into a liquid, wherein the value produced by dividing the pore diameter that accounts for 10% of the total pore volume in the relative cumulative pore distribution curve of the porous body by the pore diameter that accounts for 90% of the total pore volume in the relative cumulative pore dismeter distribution curve of the porous body is 1 to 1.5.

5 Claims, 4 Drawing Sheets schematic diagram of bubble generation by a porous body

U.S. PATENT DOCUMENTS

| | | | | |
|---|---|---|---|---|
| 4,663,089 | A * | 5/1987 | Lowry et al. | 261/23.1 |
| 6,572,084 | B1 * | 6/2003 | Ivanovich et al. | 261/64.1 |
| 7,413,713 | B2 * | 8/2008 | Sano et al. | 422/129 |

FOREIGN PATENT DOCUMENTS

| | | | |
|---|---|---|---|
| JP | 61-040841 | A | 2/1986 |
| JP | 62-25618 | B2 | 6/1987 |
| JP | 63-66777 | B2 | 12/1988 |
| JP | 2-95433 | | 4/1990 |
| JP | 02095433 | B2 | 4/1990 |
| JP | 2002-126482 | A | 5/2002 |
| JP | 2002-160941 | A | 6/2002 |

OTHER PUBLICATIONS

Sung-Ho Cho et al. "Ultrasonic formation of nanobubbles and their zeta-potentials in aqueous electrolyte and surfactant solutions", Colloids and Surfaces A: Physicochem. Eng. Aspects 269 (2005) pp. 28-34.

Maki Shoten "Progress in Chemical Engineering. 16. Bubbles, Drops, and Dispersion Engineering", 1982, pp. 232-235.

Tetsuo Yazawa et al. "Permeation of Liquid Through Porous Glass Membrane with Surface Modification", J. Ceram. Soc. Japan,, vol. 96, 1988, pp. 18-23.

"Bubbles, Drops, and Particles", Academic Press, Chapter 12—"Formation and Breakup of Fluid Particles", 1978, pp. 320-351.

Jong-Yun Kim et al., "Zeta Potential of Nanobubbles Generated by Ultrasonication in Aqueous Alkyl Polyglycoside Solutions", Journal of Colloid and Interface Science 223, 285-291 (2000).

Sung-Ho Cho et al. "Ultrasonic formation of Nanobubbles and their Zeta-Potentials in Aqueous Electrolyte and Surfactant Solutions", Colliods and Surfaces A: Physicochem. Eng. Aspects 269 (2005) 28-34.

Brian E. Oeffinger et. al., "Development and Characterization of a Nano-Scale contrast Agent", Ultrasonics 42 (2004) 343-347.

Alfonso M. Ganan-Calvo et al., "Perfectly Monodisperse Microbubbling by Capillary Flow Focusing", Physical Review Letters, vol. 87, No. 27, 2001, pp. 274501-1-274501-4.

Motohiro Yasuno et al., Monodispersed Microbubble Formation Using Microchannel Technique, AICH Journal, Dec. 2004, vol. 50, No. 12, pp. 3227-3233.

Masayoshi Takahashi et al., Effect of Shrinking Microbubble on Gas Hydrate Formation, The Journal of Physical Chemistry B, vol. 107, No. 10, Mar. 2003, pp. 2171-2173.

C. Martinez-Bazan et al., On the Breakup of an Air Bubble Injected into a Fully Developed Turbulent Flow. Part 2. Size PDF of the Resulting Daughter Bubbles, J. Fluid Mech. (1999), vol. 401, pp. 183-207.

International Search Report of PCT/JP2004/018558 dated Apr. 5, 2005.

* cited by examiner schematic diagram of bubble generation by a porous body

METHOD FOR PRODUCING MONODISPERSE BUBBLES

TECHNICAL FIELD

The present invention relates to a method for producing monodisperse bubbles.

BACKGROUND ART

Various methods for generating bubbles have already been proposed. Examples in this regard are a) gas transport methods in which a gas is passed through the micropores of a gas dispersing tube into a liquid; b) methods in which a vibration with a frequency no greater than 1 kHz is applied to a porous body while a gas is being fed into a liquid through the porous body; c) bubble generation methods that utilize ultrasound; d) shaking•stirring methods in which bubbles are generated by stirring a liquid and shearing a gas; e) methods in which a gas is dissolved under pressure in a liquid followed by pressure reduction in order to generate bubbles from the supersaturated dissolved gas; and f) chemical foaming methods in which bubbles are created by generating a gas in a liquid by a chemical reaction (refer, for example, to Clift, R. et al., "Bubbles, Drops, and Particles", Academic Press (1978), and Hideki TAKUSHOKU, "Progress in Chemical Engineering. 16. Bubble, Drop, and Dispersion Engineering", Maki Shoten, 1 (1982)).

However, these methods, excluding methods that generate microfine bubbles utilizing microwaves, not only have difficulty producing very fine bubbles with bubble diameters on the order of nanometers, but also suffer from the problem of an impaired stability due to a nonuniform bubble diameter. In addition, it is also extremely difficult in the aforementioned methods to freely adjust the bubble diameter.

DISCLOSURE OF THE INVENTION

A main object of this invention is to provide a method for generating bubbles that exhibit an excellent monodispersity.

As a result of extensive and focused investigations, the inventor discovered that this object could be achieved by applying pressure to a gas and dispersing it into a liquid through a special porous body. This invention was achieved based on this discovery.

That is, the present invention relates to the following method for preparing bubbles.

1. A method for producing bubbles by the injection and dispersion of a gas through a porous body into a liquid, wherein the porous body has a value of 1 to 1.5, wherein the value is given by dividing the pore diameter that accounts for 10% of the total pore volume in the relative cumulative pore distribution curve of the porous body by the pore diameter that accounts for 90% of the total pore volume in the relative cumulative pore diameter distribution curve of the porous body.

2. The method according to above 1, wherein the contact angle with respect to the liquid of at least the surface of the porous body that is in contact with the liquid is greater than 0° and less than 90°.

3. The method according to above 1, wherein porous glass is used as the porous body.

4. The method according to above 1, wherein the liquid contains at least one additive selected from the group consisting of emulsifying agents, emulsion stabilizers, foaming agents, and alcohols.

5. Bubbles obtained by the method according to above 1.

6. The bubbles according to above 5, wherein, in the integrated volume distribution of the bubbles, 1) the diameter at which the bubble volume accounts for 10% of the total bubble volume is at least 0.5-times the diameter at which the bubble volume accounts for 50% of the total bubble volume, and 2) the diameter at which the bubble volume accounts for 90% of the total bubble volume is no more than 1.5-times the diameter at which the bubble volume accounts for 50% of the total bubble volume.

ADVANTAGES OF THE INVENTION

The method according to the present invention can reliably produce highly monodisperse bubbles. The method according to the present invention in particular can also provide microfine monodisperse bubbles for which the bubble diameter size is in the nanometer range (monodisperse nanobubbles). In addition, the method according to the present invention also enables the bubble diameter to be freely adjusted by varying, for example, the pore diameter of the porous body.

The monodisperse bubbles and particularly the nanobubbles and/or microbubbles (microfine monodisperse bubbles for which the bubble diameter size is in the micrometer range) obtained by the method according to the present invention can be used in a broad range of fields, such as hydroponic cultivation, the cultivation of marine products, bubble-containing food products, microcapsules, pharmaceutical preparations and cosmetics, various foam materials, and separation processes such as ore flotation and bubble-utilizing foam separation.

BEST MODE FOR CARRYING OUT THE INVENTION

Figure 1:
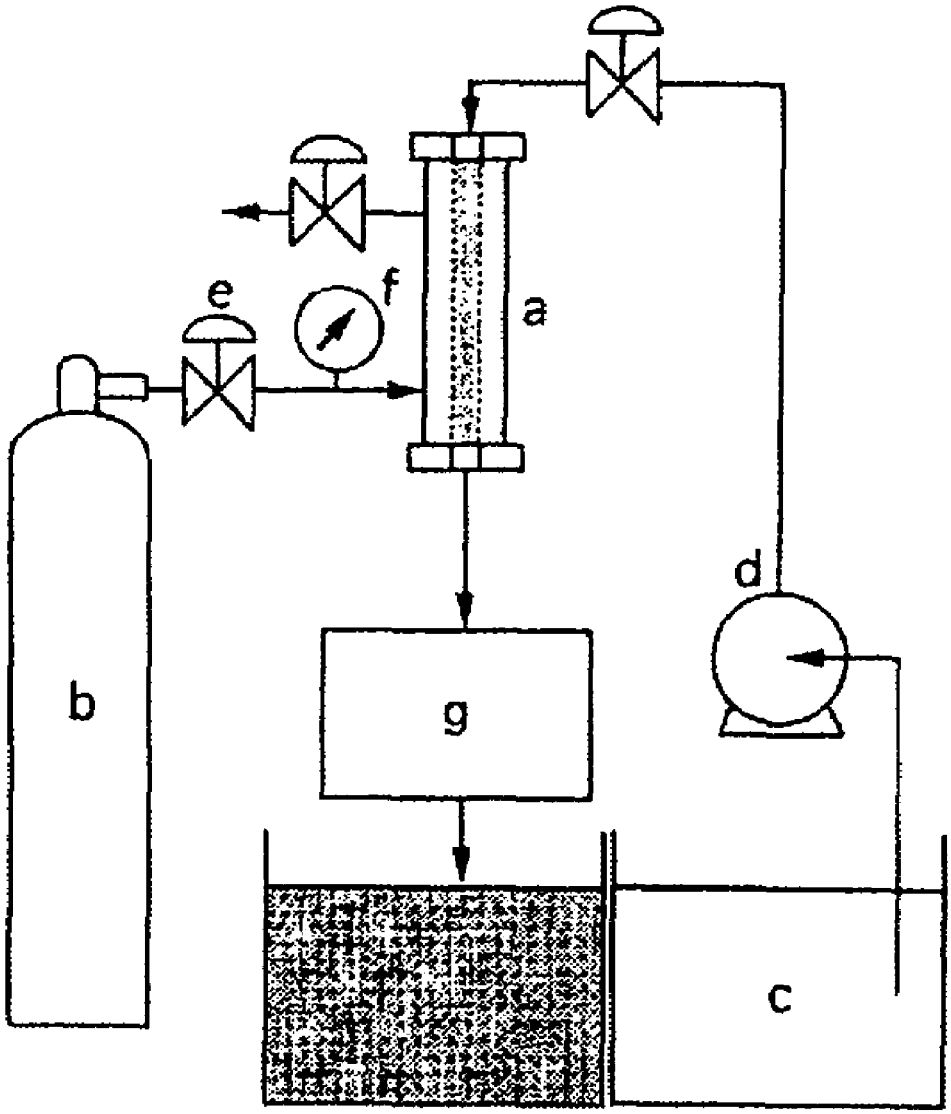
FIG. 1 is a schematic diagram that shows an example of an apparatus for executing the method according to the present invention.

The method according to the present invention for producing bubbles is a method for producing bubbles by the injection and dispersion of a gas through a porous body into a liquid, wherein the porous body has a value of 1 to 1.5, wherein the value is given by dividing the pore diameter that accounts for 10% of the total pore volume in the relative cumulative pore distribution curve of the porous body by the pore diameter that accounts for 90% of the total pore volume in the relative cumulative pore diameter distribution curve of the porous body.

As used hereinbelow with reference to the present invention, the "10% diameter" refers to the pore diameter that accounts for 10% of the total pore volume in the relative cumulative pore distribution curve of the porous body while the "90% diameter" refers to the pore diameter that accounts for 90% of the total pore volume in the relative cumulative pore diameter distribution curve of the porous body.

The Porous Body

The porous body used by the method according to the present invention has a relative cumulative pore diameter distribution curve in which the value given by dividing the 10% diameter by the 90% diameter is 1 to 1.5 and preferably 1.2 to 1.4. The use of a porous body having a pore diameter distribution in this range (that is, a porous body with a uniform pore diameter) enables the reliable production of bubbles that exhibit an excellent monodispersity.

The pore diameter of the porous is not specifically restricted, but can generally be set upon as appropriate from within the average pore diameter range of 0.02 to 25 μm (preferably 0.05 to 20 μm). The average bubble diameter of the monodisperse bubbles can also be freely adjusted in particular within the range of about 0.2 to 200 μm by adjusting the pore diameter.

The porous body can be any porous body that has a uniform pore diameter as defined hereinabove. The pore shape is not particularly limited as long as the pore shape is that of a through pore, and the pore shape can be exemplified by a cylindrical column, a square column, and so forth. The pores can run through perpendicular to the surface of the porous body or can run through obliquely, and the pores can be intertwined with each other. The pores in the porous body preferably have a uniform hydraulic diameter. Such a pore structure is very suitable for use by this invention.

The shape of the porous body is also not limited and may be any shape capable of dispersing a gas into a liquid. The porous body can be, for example, membrane shaped, block shaped, disk shaped, square column shaped, cylindrical column shaped, and so forth. This can be selected as appropriate in accordance with the intended use, service, and so forth. A membrane-shaped porous body can generally be suitably used. A membrane-shaped porous body can have the shape of a flat membrane or a pipe. In addition, a membrane-shaped porous body can be a symmetric membrane or an asymmetric membrane. Moreover, a membrane-shaped porous body can be a uniform or nonuniform membrane. These shapes and structures are selected as appropriate in correspondence to the type of liquid used, the intended bubbles, and so forth.

The size of the porous body is also not limited and can be selected as appropriate in view of the bubble generation application, the method of using the porous body, and so forth.

The material constituting the porous body is also not limited and can be selected as appropriate. Preferred materials can be exemplified by glasses, ceramics, silicon, polymers, or the like. Glasses (porous glasses) in particular can be suitably used by the present invention. Suitable for use as the porous glass is, for example, porous glass produced utilizing microphase separation in glass. The known porous glasses can be used as such porous glass, and, for example, porous glasses produced utilizing microphase separation in glass can be suitably used. Specific examples are the CaO—B2O3-SiO2-Al2O3-based porous glass disclosed in Japanese Patent 1,504,002 and the CaO—B2O3-SiO2-Al2O3-NaO2-based porous glass and CaO—B2O3-SiO2-Al2O3-NaO2-MgO-based porous glass disclosed in Japanese Patent 1,518,989 and U.S. Pat. No. 4,657,875. Also usable is the SiO2-ZrO2-Al2O3-B2O3-NaO2-CaO-based porous glass disclosed in Japanese Published Patent Application No. 2002-160941.

The porous body in the present invention desirably exhibits good wetting by the liquid used. Porous bodies that are either poorly wetted or not wetted by the liquid used can also be used after execution thereon of a surface treatment or surface modification by a known method so as to be wettable by the liquid used. Wetting by the liquid denotes a contact angle by the liquid on the surface of the porous body preferably greater than 0° and less than 90°, particularly preferably greater than 0° and less than 45°, and more preferably greater than 0° and no greater than 30°.

The Gas

There are no particular limitations on the gas used by the present invention, and a desired gas can be used as appropriate. The gas used by the present invention can be exemplified by at least one selection from the group consisting of substances that are gases at ambient temperature, such as air, nitrogen gas, oxygen gas, ozone gas, carbon dioxide, methane, hydrogen gas, ammonia, and hydrogen sulfide, and the vapors of substances that are liquid at ambient temperature, such as ethyl alcohol, water, and hexane.

The Liquid

There are also no particular restrictions on the liquid used by the present invention, and a variety of liquids can be used. The liquid used by the present invention can be exemplified by water and by oil-miscible liquids such as oils, fats, and organic solvents.

An additive can also be added to the liquid in the present invention in order to stabilize the obtained bubbles. Preferred for use as the additive is at least one selection from emulsifying agents, emulsion stabilizers, foaming agents, and alcohols.

The emulsifying agent can be any emulsifying agent that has the ability to lower the interfacial tension of the liquid, and known emulsifying agents and commercial products can be used. In addition, either a water-soluble emulsifying agent or an oily emulsifying agent can be used as the emulsifying agent.

The known hydrophilic emulsifying agents can be used as the water-soluble emulsifying agent. For example, nonionic emulsifying agents can be exemplified by glycerol fatty acid esters, sucrose fatty acid esters, sorbitan fatty acid esters, polyglycerol fatty acid esters, polyoxyethylene hydrogenated castor oil, polyoxyethylene-polyoxypropylene glycols, lecithin, and polymeric emulsifying agents. The anionic emulsifying agents can be exemplified by carboxylic acid salts, sulfonic acid salts, and sulfate ester salts. The HLB of these hydrophilic emulsifying agents is preferably at least 8.0 and more preferably is at least 10.0 These hydrophilic emulsifying agents can be used individually or in combinations of two or more in correspondence to the desired emulsifying activity. The quantity of addition of these hydrophilic emulsifying agents is not specifically limited as long as an adequate emulsifying effect is obtained; generally, however, about 0.05 to 1 weight % with reference to the emulsion as a whole will be appropriate.

Nonionic emulsifying agents, for example, can be used as the oily emulsifying agent. More specific examples are glycerol fatty acid esters, sucrose fatty acid esters, sorbitan fatty acid esters, propylene glycol fatty acid esters, polyglycerol fatty acid esters, polyoxyethylene hydrogenated castor oil, polyoxyethylene-polyoxypropylene glycols, lecithin, and so forth. These can be used individually or two or more can be used. Particularly preferred among the preceding are polyglycerol fatty acid esters, sucrose fatty acid esters, and so forth. The quantity of addition of the oily emulsifying agent can be determined as appropriate in view, inter alia, of the type of oily emulsifying agent used; generally, however, about 0.05 to 30 weight % in the liquid is appropriate.

The emulsion stabilizer is a substance that coats the gas-liquid interface of the generated bubbles and thereby stabilizes the bubbles. The emulsion stabilizer can be exemplified by synthetic polymers such as polyvinyl alcohol and polyethylene glycol. Its quantity of addition is not particularly limited as long as a satisfactory bubble-generating effect is obtained; generally, however, about 0.05 to 50 weight % in the liquid is appropriate.

The foaming agent is a substance that can facilitate bubble generation, but is not otherwise limited. The foaming agent can be exemplified by glycosides such as saponins; polysaccharides such as sodium alginate and carrageenan; and proteins such as albumin and casein. The quantity of addition is not limited as long as a satisfactory bubble-generating effect is obtained; generally, however, about 0.05 to 50 weight % in the liquid is appropriate.

The alcohol can be exemplified by ethyl alcohol, propyl alcohol, and butanol. Addition of the alcohol facilitates bubble generation by reducing the interfacial tension $\gamma$ of the liquid. The quantity of alcohol addition is not particularly limited as long as an adequate bubble-generating effect is obtained; generally, however, about 0.05 to 50 weight % in the liquid is appropriate.

The method for generating monodisperse bubbles

The method according to the present invention generates bubbles by the injection and dispersion of a gas through the porous body described hereinabove into a liquid.

There are no particular limitations on the procedure for injection and dispersion. Injection and dispersion can be carried out, for example, as follows. First, a side of the porous body is brought into contact with a liquid and another side is brought into contact with a gas. Then, by pressurizing the gas, the gas is caused to traverse the through pores of the porous body and to disperse into the liquid. Methods for pressurizing the gas can be exemplified by methods in which the gas is forcibly filled into a sealed space and methods in which the gas is filled into a sealed space and the air is thereafter compressed with, for example, a piston.

An example of a preferred embodiment of the execution of the method according to the present invention is provided hereafter. A liquid (c) is transported to a porous glass membrane and membrane module (a) by a pump (d). A gas in a gas cylinder (b) is transported to the porous glass membrane and membrane module (a) under regulation by a valve (e) while referring to a pressure gauge (f). Proceeding in this manner enables the dispersion of bubbles in the liquid. The particle diameters of the obtained bubbles can be measured by a particle size distribution analyzer based on the laser diffraction method (g).

Figure 2:
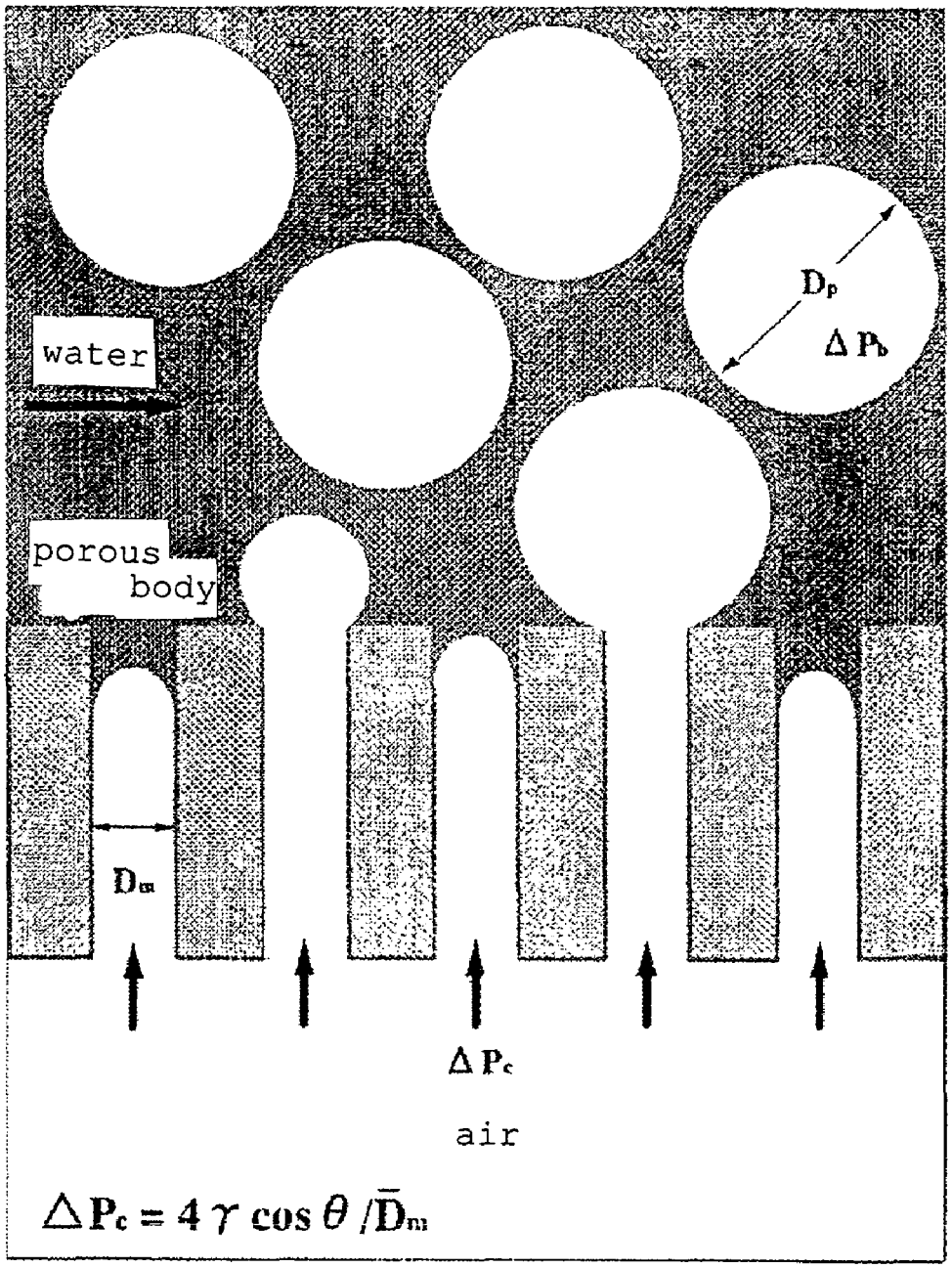
FIG. 2 is a schematic diagram of a bubble-generating apparatus.

FIG. 2 is a schematic diagram of bubble generation at the porous body when the gas is pressurized. The minimum pressure $\Delta Pc$ at which bubble generation begins is generally given by the following equation;

$$\Delta P = 4\gamma \cos\theta / Dm$$

wherein $\gamma$ is the surface tension of the liquid relative to the gas, $\theta$ is the angle of contact relative to the air of the liquid present at the surface of the porous body, and Dm is the average pore diameter of the porous body.

In the present invention, in order to obtain monodisperse bubbles having a smaller average bubble diameter, the pressure difference $\Delta P$ (=PA−PL) between PA of the gas when the gas is pressurized and the pressure PL of the liquid is desirably controlled to about 0.2 to 10 MPa and particularly about 1 to 5 MPa.

Bubble generation may be carried out by the present invention according to either a batch or continuous regime. The continuous regime, when used, is desirably carried out as follows. When, for example, the porous body is a flat membrane, the liquid is preferably stirred with, for example, a stirrer. When, for example, the porous body is a tubular membrane, the liquid is preferably circulated using a pump. The particle diameter of the obtained monodisperse bubbles can be measured by known methods using commercially available particle diameter measurement instruments.

The Bubbles

The bubbles obtained by the method according to the present invention (bubbles according to the present invention) in general have small bubble diameters and are monodisperse. In particular, the bubbles have a high monodispersity that, in the cumulative volume distribution of the bubbles, the diameter at which the bubble volume accounts for 10% of the total bubble volume is at least 0.5-times (preferably about 0.6- to 0.8-times) the diameter at which the bubble volume accounts for 50% and the diameter at which the bubble volume accounts for 90% of the total bubble volume is no more than 1.5-times (preferably about 0.2- to 1.4-times) the diameter at which the bubble volume accounts for 50%.

While there is no limitation on the average bubble diameter of the bubbles according to the present invention, this value is ordinarily about 0.2 to 200 μm and can be decided upon as appropriate in correspondence to the specific application and so forth. In particular, the bubble diameter of the bubbles can be controlled into a freely selected range in the method according to the present invention by altering the pore diameter of the porous body used. The method according to the present invention can also produce, for example, 400 nm to 900 nm nanobubbles.

The bubbles according to the present invention can be used in a variety of applications, such as in the medical field and for agricultural chemicals, cosmetics, food products, and so forth. With regard to medical applications, the bubbles according to the present invention can specifically be used in contrast media and drug delivery system (DDS) formulations. When nanobubbles are incorporated into the contrast media used in ultrasound diagnosis, the sensitivity of the contrast media is dramatically improved due to the fact that the bubbles exhibit a unique sensitization action with respect to ultrasound. In addition, the introduction of bubbles into microcapsules also makes it possible to rupture the microcapsules at a target region by exposure to shock waves and thereby release a drug present in the capsule.

In the field of food products, the stability of the monodisperse nanobubbles or monodisperse microbubbles can be used to improve the texture and taste of, for example, mousse food products. In addition, by injecting nanobubbles of an inert gas such as nitrogen into a beverage, such as milk or PET bottle or bag tea, the dissolved oxygen that is a cause of beverage deterioration can be very efficiently removed, thereby enabling an inhibition of quality deterioration.

With regard to cosmetic applications, the stability of the monodisperse nanobubbles or monodisperse microbubbles enables use as a high-quality mousse (hair setting materials, skin cream, and so forth).

With regard to biological and chemical applications, the invention can be very suitably used in hydroponic cultivation, marine cultivation, and so forth, by utilizing the very large surface area of nanobubbles and microbubbles for the dissolution of oxygen in water. In addition, water can also be sterilized very efficiently using ozone nanobubbles. Moreover, because nanobubbles and microbubbles exhibit a binding activity for substances present in the liquid, due to their large surface area they can very efficiently inhibit the proliferation of microorganisms (antimicrobial activity) and can very efficiently effect the separation and recovery of suspended material (ore flotation and foam separation).

Otherwise, bringing the body into contact with nanobubbles or microbubbles at, for example, a bathhouse or hot spring, provides better stimulation of blood flow, a better temperature maintenance effect, a better skin reviving effect, and so forth.

EXAMPLES

The invention is described in additional detail hereinbelow through examples. However, the scope of the invention is not limited to these examples.

Example 1

Using the apparatus shown in FIG. 1, air was injected and dispersed through a tubular porous glass membrane having an average pore diameter of 85 nm (SPG membrane from SPG Technology Co., Ltd.) into an aqueous solution containing 0.1 weight % anionic emulsifying agent (sodium dodecyl sulfate). The pressure difference ΔP between the air and the aqueous solution was 3.0 MPa and the liquid temperature was 25° C. The aqueous solution was transported by a pump and the in-tube flow velocity within the membrane was set at 4.0 m/s.

Figure 3:
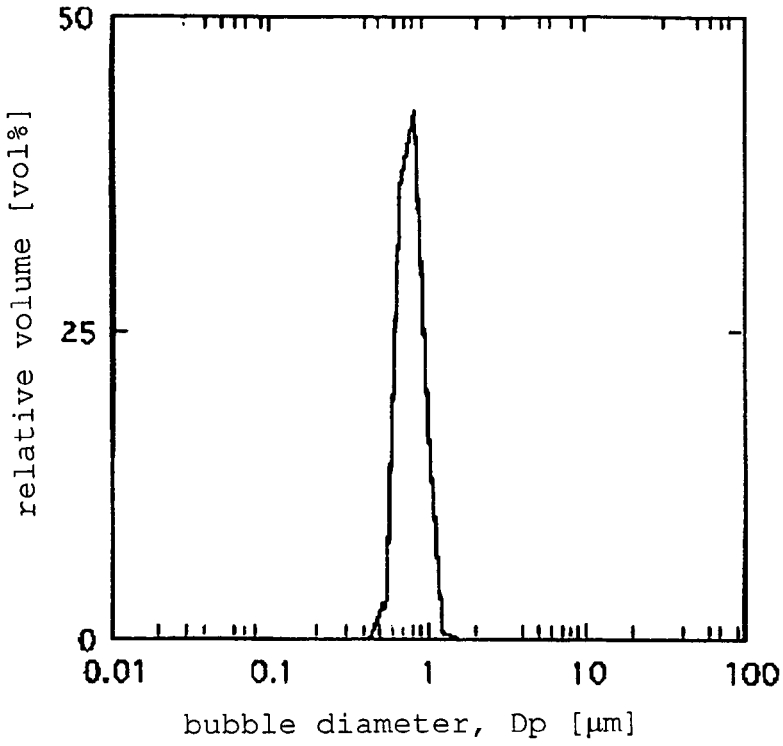
FIG. 3 shows the bubble diameter distribution of the nanobubbles obtained in Example 1.

The generated bubbles were directly introduced into the measurement cell of a particle diameter distribution measurement instrument (product name: "SALD2000", from the Shimadzu Corporation). The obtained bubble diameter distribution is shown in FIG. 3. As is clear from FIG. 3, the obtained bubbles were highly monodisperse nanobubbles having an average bubble diameter of 750 nm.

Example 2

Figure 4:
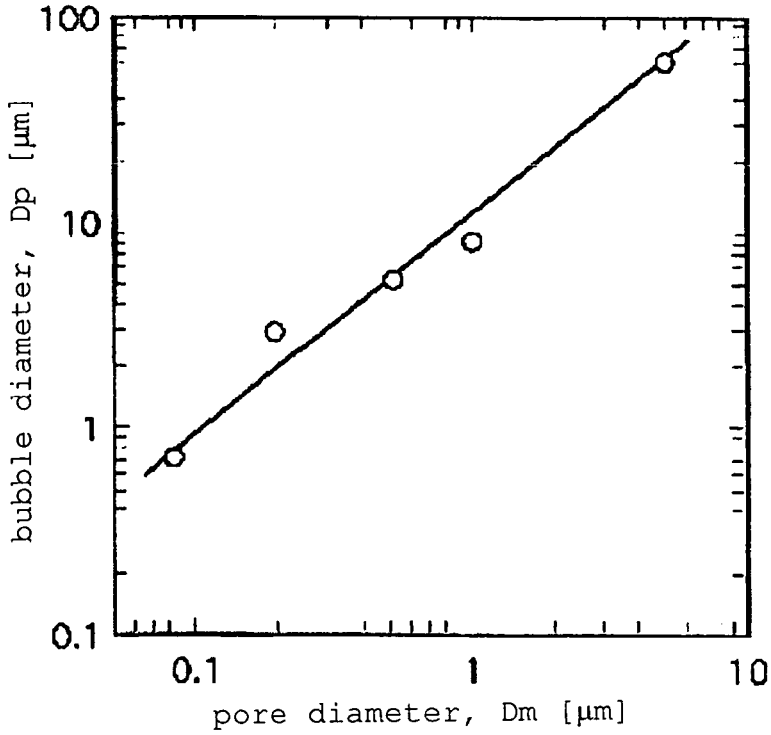
FIG. 4 shows the relationship between the average pore diameter of a porous glass membrane and the average bubble diameter.

The relationship between the pore diameter of the porous glass membrane and the average bubble diameter of the generated bubbles was investigated in accordance with Example 1 by varying the average pore diameter of the porous glass membrane. The results are shown in FIG. 4. As is clear from FIG. 4, a linear relationship given by Dp=8.6 Dm exists between the average bubble diameter Dp and the average pore diameter Dm.

Example 3

Figure 5:
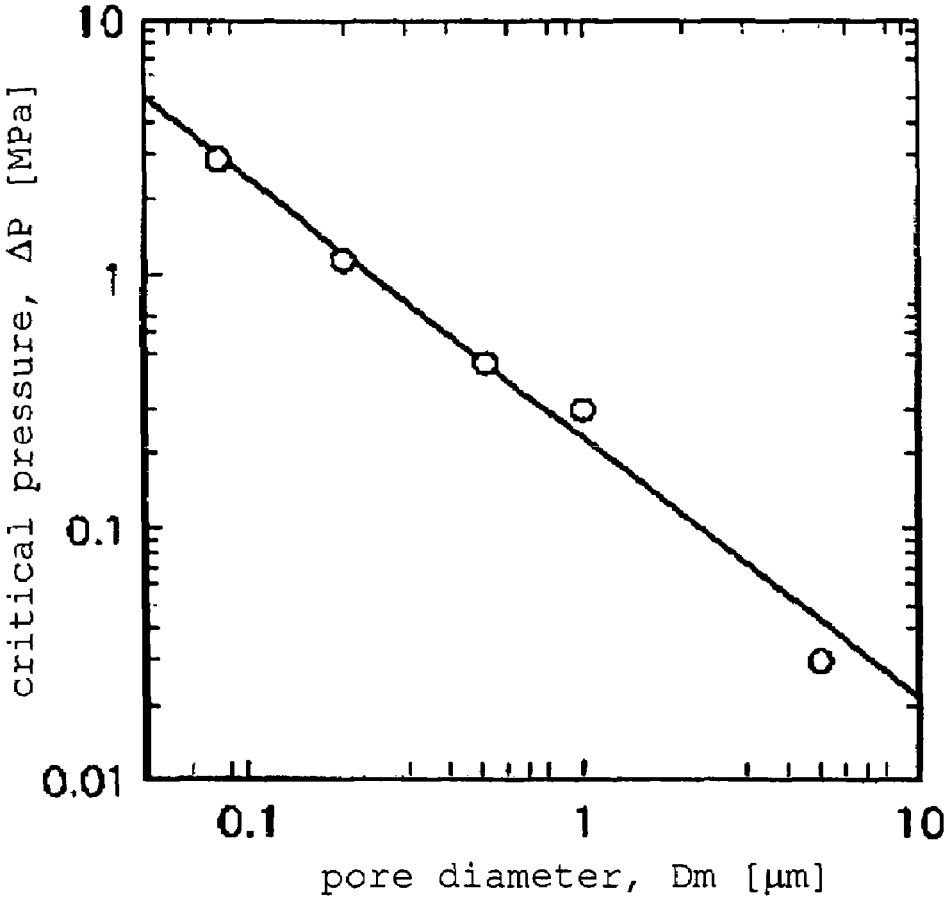
FIG. 5 shows the relationship between the critical pressure and the average pore diameter of a porous glass membrane.

The relationship for the minimum pressure ΔPc (critical pressure) at which bubble generation began for different average pore diameters in the porous glass membrane was investigated in accordance with Example 1 by varying the average pore diameter of the porous glass membrane. The results are shown in FIG. 5. The relationship between ΔP and Dm was in approximate agreement with the equation shown above by (1) $\Delta P=4\gamma \cos\theta/Dm$.

Example 4

The contact angle θ between the aqueous phase and the porous glass membrane used in Example 1 was measured by the liquid-capillary-rising method (Yazawa, T., H. Nakamichi, H. Tanaka and K. Eguchi; "Permeation of Liquid through Porous Glass Membrane with Surface Modification," J. Ceram. Soc. Japan, 96, 18-23 (1988)). The result was a contact angle of θ=28°.

The invention claimed is:

1. A method for producing bubbles by the injection and dispersion of a gas through a porous body into a liquid, wherein the porous body has a value of 1 to 1.5, wherein the value is given by dividing the pore diameter that accounts for 10% of the total pore volume in the relative cumulative pore distribution curve of the porous body by the pore diameter that accounts for 90% of the total pore volume in the relative cumulative pore diameter distribution curve of the porous body, wherein the contact angle with respect to the liquid of at least the surface of the porous body that is in contact with the liquid is greater than 0° and less than 90°, wherein the gas is pressurized so that (1) the pressure is not less than the minimum pressure ΔPc given by the following equation;

$$\Delta Pc=4\gamma \cos\theta/Dm$$

wherein γ is the surface tension of the liquid relative to the gas, θ is the angle of contact relative to air of the liquid present at the surface of the porous body, and Dm is the average pore diameter of the porous body, and (2) the pressure difference ΔP between the pressure of the gas when the gas is pressured and the pressure of the liquid is controlled to 0.2 to 10 MPa.

2. The method according to claim 1, wherein porous glass is used as the porous body.

3. The method according to claim 1, wherein the liquid contains at least one additive selected from the group consisting of emulsifying agents, emulsion stabilizers, foaming agents, and alcohols.

4. Bubbles having the average bubble diameter of 400 nm to 900 nm obtained by the method according to claim 1.

5. The bubbles according to claim 4, wherein, in the integrated volume distribution of the bubbles, 1) the diameter at which the bubble volume accounts for 10% of the total bubble volume is at least 0.5-times the diameter at which the bubble volume accounts for 50% of the total bubble volume, and 2) the diameter at which the bubble volume accounts for 90% of the total bubble volume is no more than 1.5-times the diameter at which the bubble volume accounts for 50% of the total bubble volume.

* * * * *